US006821137B2

(12) United States Patent
Koser

(10) Patent No.: US 6,821,137 B2
(45) Date of Patent: Nov. 23, 2004

(54) CONNECTOR FOR A CARD-TYPE ELECTRONIC DEVICE

(75) Inventor: James R. Koser, Elizabethtown, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/350,249

(22) Filed: Jan. 23, 2003

(65) Prior Publication Data

US 2004/0147151 A1 Jul. 29, 2004

(51) Int. Cl.[7] ..... H01R 13/15
(52) U.S. Cl. ..... 439/260
(58) Field of Search ..... 439/260, 267

(56) References Cited

U.S. PATENT DOCUMENTS 4,874,323 A 10/1989 Shibano ..... 439/260
4,919,626 A 4/1990 Anhalt et al. ..... 439/260
4,961,710 A * 10/1990 Komatsu ..... 439/267
5,012,078 A 4/1991 Pernet ..... 235/441
6,126,466 A 10/2000 Inadama ..... 439/260
6,179,638 B1 1/2001 Lim ..... 439/260
6,325,653 B1 12/2001 Takahashi ..... 439/260

* cited by examiner

*Primary Examiner*—Renee Luebke
*Assistant Examiner*—Ann McCamey
(74) *Attorney, Agent, or Firm*—Woodcock Washburn LLP

(57) ABSTRACT

A preferred embodiment of a connector for a card-type electronic device comprises a casing having an opening therein for receiving the card-type electronic device, a plurality of electrically-conductive terminals mounted on the casing, and a cam member pivotally coupled the casing for lifting an end portion of the card-type electronic device in response to an insertion force exerted on the card-type electronic device to advance the card-type electronic device into the connector.

19 Claims, 7 Drawing Sheets

CONNECTOR FOR A CARD-TYPE ELECTRONIC DEVICE

FIELD OF THE INVENTION

The present invention relates to electrical connectors. More particularly, the present invention relates to connectors for electrically coupling a card-type electronic device, such as a PC card, to a circuit substrate.

BACKGROUND OF THE INVENTION

Card-type electronic devices such as PC cards are often used in conjunction with a connector that receives the PC card. The connector can be mounted on a circuit substrate such as a printed circuit board ("PCB"). The connector electrically couples the PC card to the PCB when the PC card is fully inserted in the connector.

The PC card is typically inserted into a slot formed in the connector. The PC card usually has some type of contact surfaces associated therewith, e.g., electrically-conductive pads, contact terminals, etc. The connector typically has a plurality of electrically-conductive terminals mounted therein.

Advancing the PC card into the connector eventually brings the terminals of the connector into contact with the contact surfaces of the PC, card, thereby establishing electrical contact between the PC card and the connector. The terminals are typically positioned within the connector so that the terminals resiliently deflect as the terminals engage the contact surfaces. The resilient deflection of the terminals establishes a contact force that enhances the electrical connection between the connector and the PC card.

Interference can occur between the PC card and the terminals as the PC card is inserted into the connector. For example, the terminals often slide along the forward edge or the casing of the PC card before making contact with the contact surfaces thereof. Moreover, the terminals often slide over the contact surfaces before reaching their final relative position on the contact surfaces.

The noted interference between the terminals and the various components of the PC card can have detrimental effects. For example, an electrically-insulating coating is often applied to the exterior surfaces of PC cards. Interference between the terminals of the connector and the coating can scratch or otherwise damage the coating. Moreover, frequent insertions and removals of the PC card (common in many applications) can cause premature wear or failure of the terminals, and the contact surfaces and casing of the PC card.

Consequently, an ongoing need exists for a connector for a card-type electronic device in which contact between the terminals of the connector and the card-type electronic device is minimized during insertion and removal of the card-type electronic device. Although connectors have been developed in an attempt to achieve this goal, such connectors tend to be relatively large and mechanically complex. These qualities are particularly disadvantageous in light of ongoing consumer demands for smaller, simpler, lighter, and less expensive connectors.

SUMMARY OF THE INVENTION

A preferred embodiment of a connector for a card-type electronic device comprises a casing having an opening therein for receiving the card-type electronic device, a plurality of electrically-conductive terminals mounted on the casing, and a cam member pivotally coupled the casing for lifting an end portion of the card-type electronic device in response to an insertion force exerted on the card-type electronic device to advance the card-type electronic device into the connector.

Another preferred embodiment of a connector for a card-type electronic device comprises a casing having an opening therein for receiving the card-type electronic device, a plurality of electrically-conductive terminals mechanically coupled to the casing for electrically contacting a plurality of electrical contact points on the circuit substrate, and a cam member pivotable between a first position and a second position. An end portion of the card-type electronic device is positionable over at least a portion of the cam member when the cam member is in the first position. The cam member lifts the end portion of the card-type electronic device when the cam member is in the second position so that the card-type electronic device is electrically coupled to the terminals.

Another preferred embodiment of a connector for a card-type electronic device comprises a casing having an opening therein for receiving the card-type electronic device, a plurality of electrically-conductive terminals mounted on the casing, and a cam member pivotally coupled the casing. The card-type electronic device is advanced into the connector in a first direction in response to an insertion force exerted on the card-type electronic device. Advancement of the card-type electronic device in the first direction causes the card-type electronic device to initially contact the cam member without substantially contacting the terminals. The cam member pivots and lifts an end portion of the card-type electronic device in a second direction toward the terminals in response to further advancement of the card-type electronic device after the card-type electronic device initially contacts the cam member.

BRIEF DESCRIPTION OF THE DRAWINGS

The foregoing summary, as well as the following detailed description of a presently-preferred embodiment, is better understood when read in conjunction with the appended drawings. For the purpose of illustrating the invention, the drawings show an embodiment that is presently preferred. The invention is not limited, however, to the specific instrumentalities disclosed in the drawings. In the drawings.

DESCRIPTION OF PRESENTLY-PREFERRED EMBODIMENTS

Figure 1:
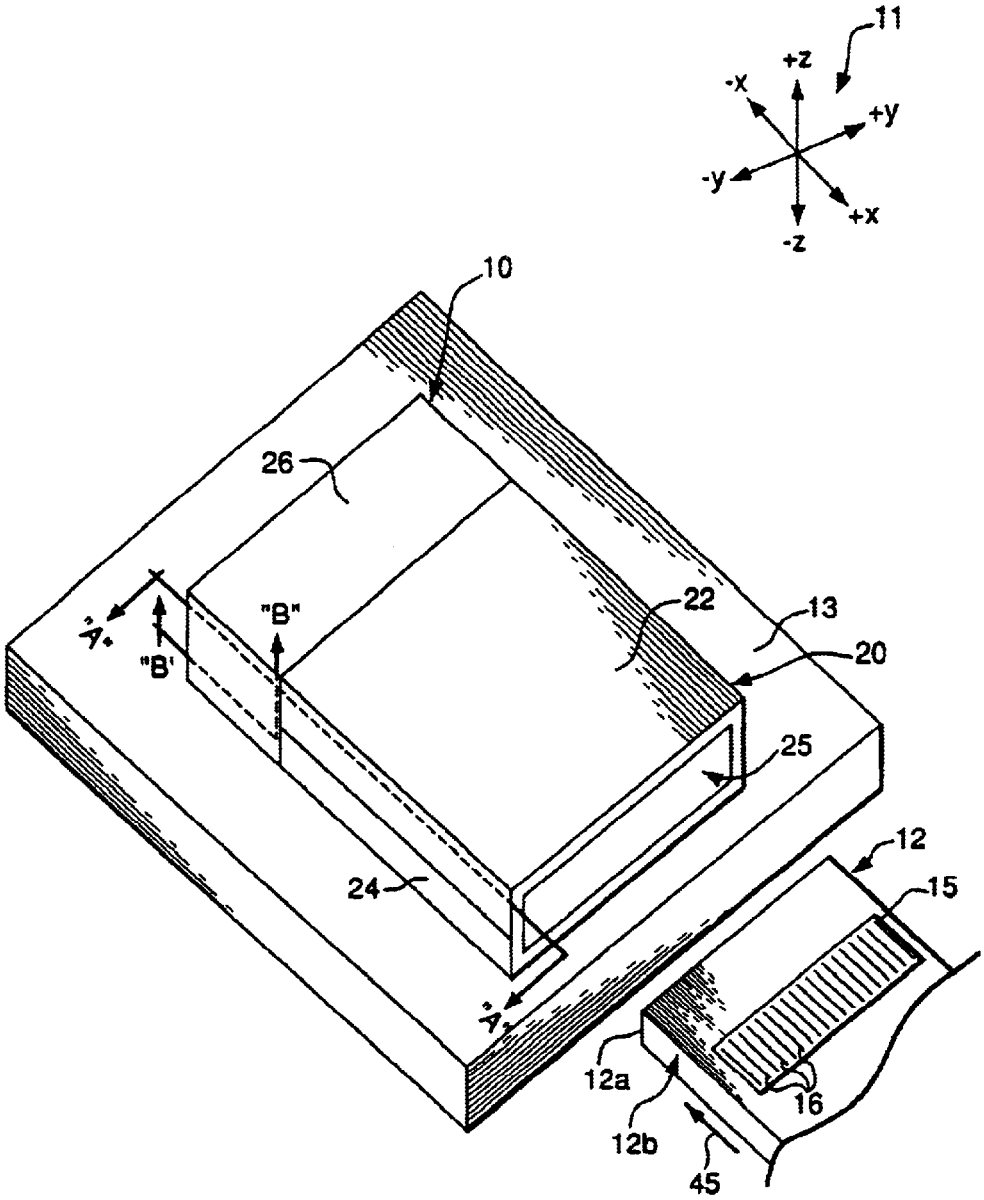
FIG. 1 is a diagrammatic perspective view of a preferred embodiment of a connector for a card-type electronic device, with the connector mounted on a PCB and about to receive a PC card.
Figure 2:
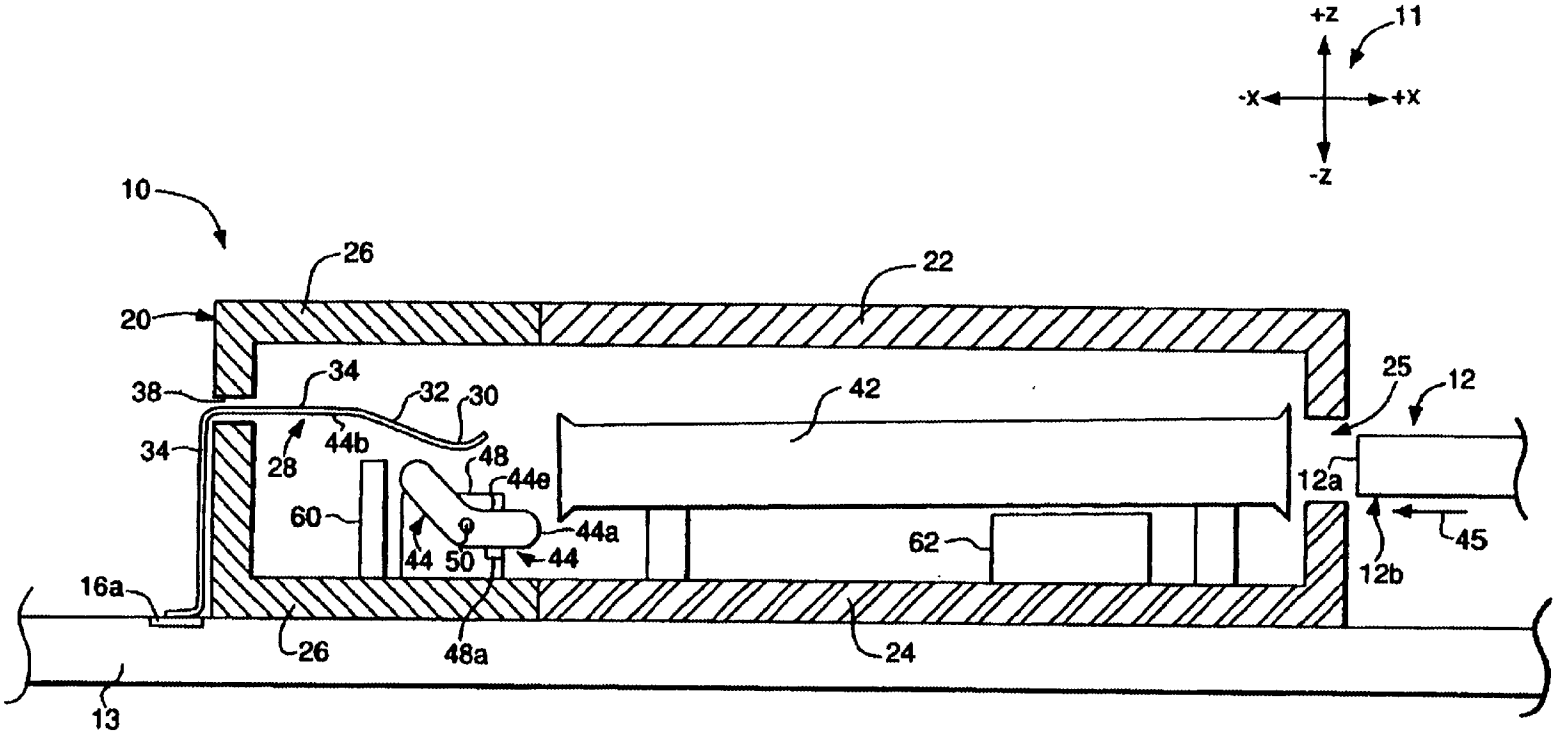
FIG. 2 is a diagrammatic cross-sectional view of the connector shown in FIG. 1 taken along the line "A-A" of FIG. 1, with the connector mounted on the PCB and about to receive the PC card shown in FIG. 1.
Figure 3:
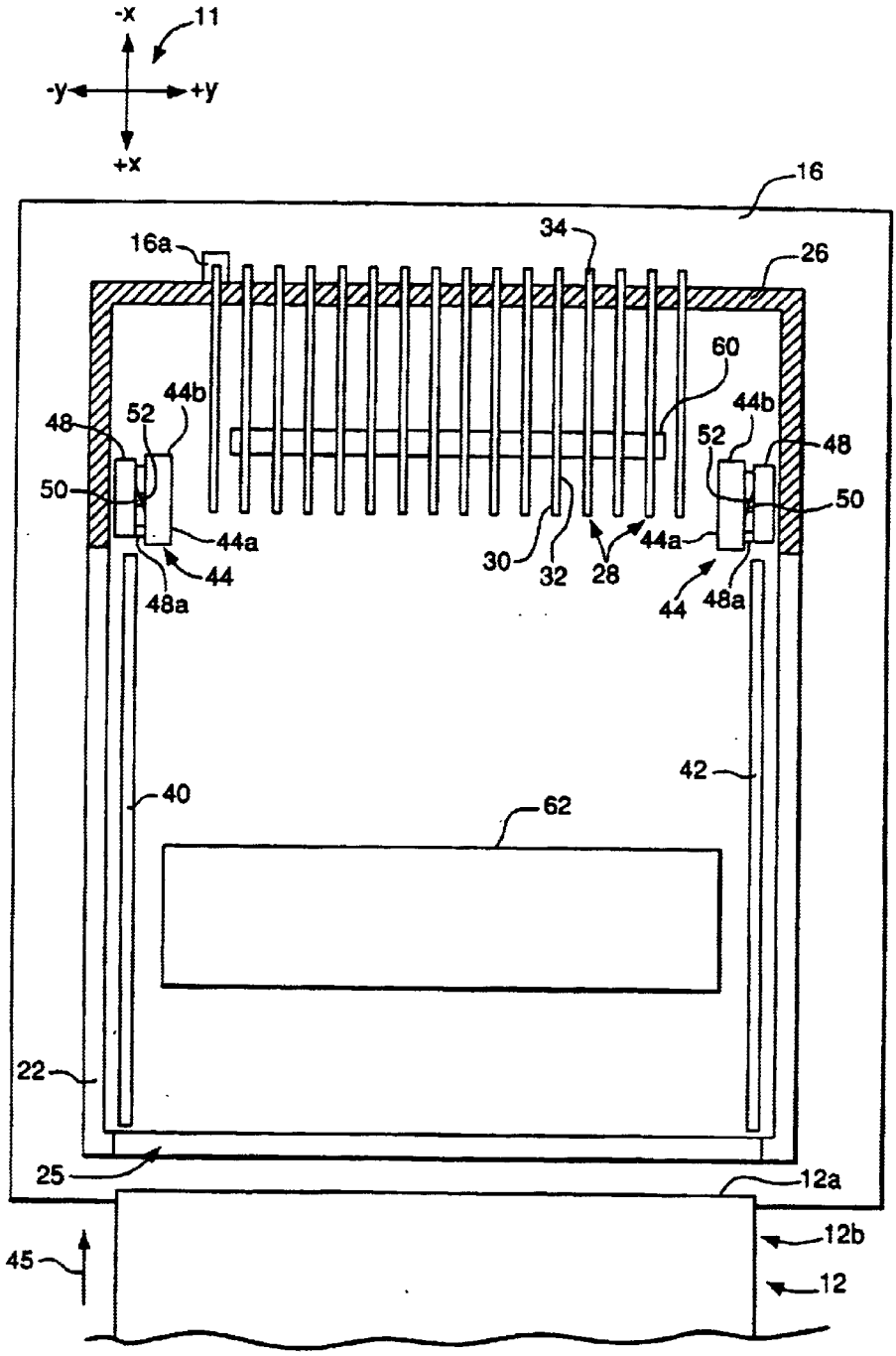
FIG. 3 is a diagrammatic top view of the connector shown in FIGS. 1 and 2, with an upper portion of a cover of the connector removed and showing the connector in partial cross-section taken through the line "B-B" of FIG. 1, with the connector mounted on the PCB and about to receive the PC card shown in FIG. 1.

A preferred embodiment of a connector 10 for electrically coupling a card-type electronic device to a circuit substrate, and various components of the connector 10, are depicted in FIGS. 1–3. The figures are each referenced to a common coordinate system 11 included therein.

The connector 10 is described herein in conjunction with a first type of PC card 12. The use of this particular type of card-type electronic device is disclosed for exemplary purposes only. The connector 10 can be configured for use with any type of PC card, such as but not limited to PCMCIA, Smart Cards, Smart Media, or the currently being developed "Newcard," and with any type of card-type electronic device. The connector 10 is also described in conjunction with a PCB 13. The use of this particular type of circuit substrate is disclosed for exemplary purposes only, as the connector 10 can be configured for use with any type of circuit substrate.

Figure 4:
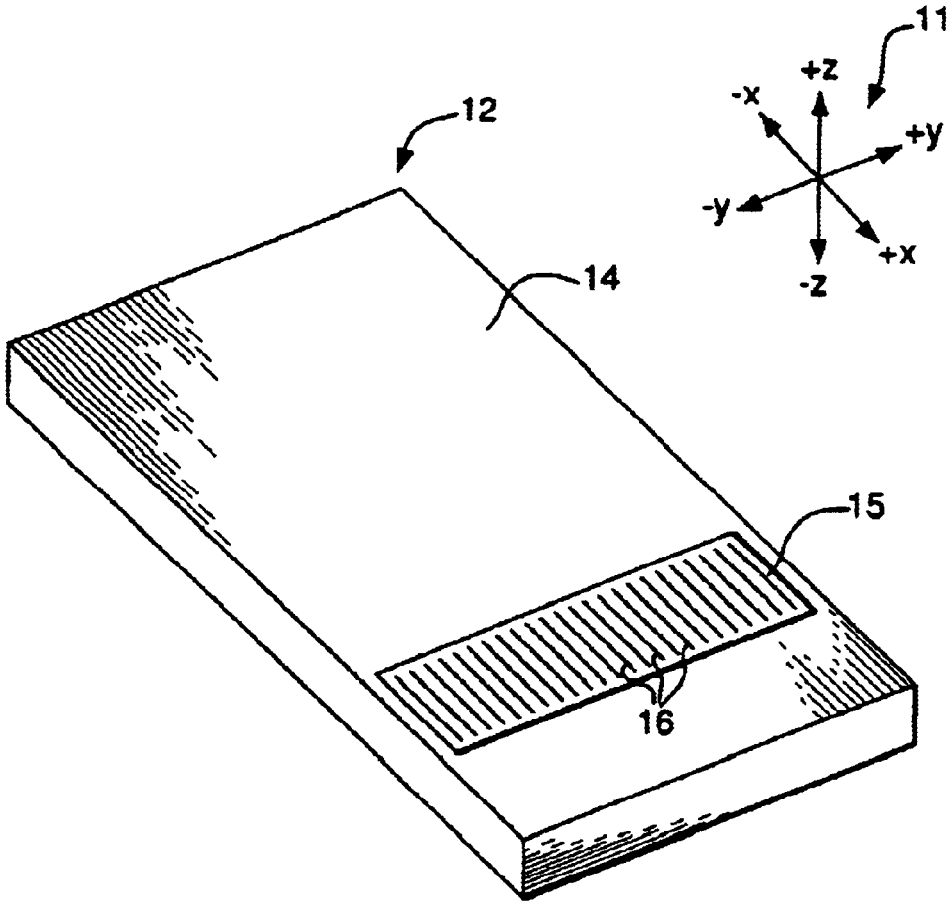
FIG. 4 is a diagrammatic perspective view of the PC card shown in FIGS. 1–3.

The first type of PC card 12 comprises a casing 14 (see FIG. 4). The casing 14 is covered with an insulating coating. The PC card 12 also comprises an upwardly-facing contact surface 15. The contact surface 15 has a plurality of electrically-conductive pads 16 formed thereon for establishing electrical contact with the PC card 12. Further details relating to the PC card 12 are not necessary to an understanding of the invention, and therefore are not presented herein.

The connector 10 comprises a casing 20 (see FIGS. 1–3). The casing 20 preferably includes an upper portion 22 and a lower portion 24. The upper portion 22 can be secured to the lower portion 24 by conventional means such as fasteners or interlocking features (not shown) formed thereon. The upper and lower portions 22, 24 define an elongated opening 25 in the casing 20. The connector 10, as discussed below, receives the PC card 12 by way of the opening 25. The upper and lower portions 22, 24 are formed from an electrically-insulating material.

The casing 20 can also comprise a terminal portion 26. The terminal portion 26 is fixedly coupled to the upper and lower portions 22, 24 as shown in FIGS. 1 and 2. The terminal portion 26 can be secured to the upper and lower portions 22, 24 by conventional means such as fasteners, or interlocking features (not shown) formed thereon. The terminal portion 26 is formed from an electrically-insulating material. It should be noted that the terminal portion 26 and the upper and lower portions 22, 24 of the casing 20 can be formed unitarily, or as two pieces in alternative embodiments.

The connector 10 further comprises a plurality of electrically-conductive terminals 28. The terminals 28 can each include a contact portion 30 and an adjoining beam portion 32 (see FIG. 2). Each mating portion 30 preferably has a curvilinear profile as shown in FIG. 2. Each of the terminals 28 can also include a lead portion 34 that adjoins the beam portion 32.

The terminals 28 are mounted on the terminal portion 26. More particularly, the lead portion 34 of each terminal 28 extends through a corresponding penetration 38 formed in the terminal portion 26 (see FIG. 2). The lead portions 34 (and the corresponding terminals 28) can be secured to the lead portion 26 by conventional means such as adhesive or mechanical locking features.

The terminals 28, as discussed below, are positioned so that the contact portions 30 thereof each contact a respective one of the pads 16 on the PC card 12 as the PC card 12 is inserted in the connector 10. The significance of this feature is discussed below.

An end of each lead portion 34 can be electrically coupled to a corresponding electrical contact point 16*a* on the PCB 13 by conventional means such as soldering, thereby establishing electrical contact between the connector 10 and the PCB 13 (see FIGS. 2 and 3; only one of the electrical contact points 16*a* is shown in FIG. 3, for clarity.)

The connector 10 may also comprise a first and second guide rail 40, 42 fixedly coupled to the lower portion 24 of the casing 20 (see FIGS. 2 and 3). The first and second guide rails 40, 42 are substantially aligned with the opening 25 defined by the casing 20. The first and second guide rails 40, 42 each extend between a first position proximate the opening 25, and a second position proximate the terminal portion 26. The first and second guide rails 40, 42, as discussed below, are spaced apart so as to receive opposing side portions of the PC card 12 when the PC card 12 is inserted into the connector 10 by way of the opening 25.

The connector 10 further comprises two cam members 44 (see FIGS. 2–5C). The cam members 44 are each pivotally coupled to the casing 20. For example, each of the cam members 44 can be pivotally coupled to respective shafts 50 that extend through through holes 51 formed in the cam members 44. The shafts, 50, in turn, can be fixedly coupled to mounting features 48 formed in the lower half 24 of the casing 20.

The cam members 44 lift a portion of the PC card 12 as the PC card 12 is inserted into the connector 10, and thereby cause each of the terminals 28 to contact a respective one of the pads 16 on the PC card 12. Specific details of this feature are discussed below.

Each cam member 44 preferably comprises an elongated first portion 44*a*, and an elongated second portion 44*b* that adjoins the first portion 44*a*. The first portion 44*a* has a leading edge 44*c*, and the second portion 44*d* has a trailing edge 44*b*. The leading edge 44*c* and the trailing edge 44*d* are preferably rounded.

The first portion 44*a* is angled in relation to the second portion 44*b*. More particularly, the first and second portions 44*a*, 44*b* each have a centerline designated by the lines "C" and "D," respectively, in FIG. 5C. The centerlines C and D are oriented at a relative angle designated "$\alpha$" in FIG. 5C. The angle $\alpha$ is preferably between approximately 90 degrees and approximately 180 degrees, depending upon the position of shaft 50 and the lengths of the first and second portions 44*a*, 44*b*.

Figure 5A:
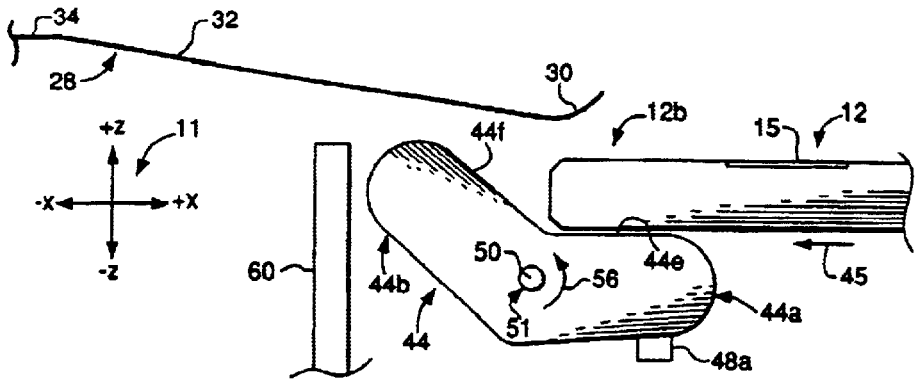
FIG. 5A is a diagrammatic side view of a cam member of the connector shown in FIGS. 1–3 as the PC card shown in FIGS. 1–4 is inserted into the connector and initially contacts the cam member.

A spring, such as a helical spring 52, can be mechanically coupled to each of the cam members 44 and the corresponding mating features 48 (see FIG. 3). The springs 52 bias the cam members 44 in a clockwise direction (from the respective of FIGS. 2 and 5A–5C). In particular, the springs 52 bias each of the cam members 44 against a stop 48*a* formed in the corresponding mating feature 48 (see FIGS. 3 and 4). The centerline C of the first portion 44*a* extends substantially in the "x" direction when the cam members 44 are positioned against the respective stops 48*a*, as shown in FIGS. 2 and 5A. (This position is hereinafter referred to as the "first position" of the cam members 44.)

A first major surface 44*e* of each cam member 44 is substantially aligned with a bottom of a respective one of the first and second guide rails 40, 42 when the cam member 44 is in its first position (see FIG. 2). The significance of this feature is discussed below.

The cam members 44 lift the PC card 12 as the PC card 12 is inserted into the connector 10. More particularly, the cam members 44 lift the PC 12 card in response to the force used to insert the PC card 12 into the connector 10. The lifting action of the cam members 44, as discussed in detail below, brings the pads 16 on the PC card 12 into contact with the terminals 28 of the connector 10.

Notably, the configuration of the connector 10, and in particular the cam members 44, inhibits substantial contact between a forward edge 12*a* of the PC card 12 and the terminals 28 as the PC card 12 is inserted into the connector 10. The configuration of the cam members 44 also inhibits substantial contact between the casing 14 of the PC card 12 and the terminals 28 as the PC card 12 is inserted. The substantial benefits associated with these features are discussed below.

The PC card 12 is inserted into the connector 10 by way of the opening 25 defined by the casing 20, as noted previously. The PC card 12 can be inserted by substantially aligning an end portion 12*b* of the PC card with the opening 25, and inserting the end portion 12*b* through the opening 25. An insertion force can be manually exerted on the PC card 12 to advance the PC card 12 in the "−x" direction and into the casing 20. (The direction of insertion of the PC card 12 is denoted by the arrow 45 included in FIGS. 1–5B.)

The first and second guide rails 40, 42 engage the PC card 12 as the PC card 12 is inserted through the opening 25. More particularly, the first and second guide rails 40, 42 are substantially aligned with the opening 25, and extend from a first position proximate the opening 25, as noted above. Moreover, the first and second guide rails 40, 42 are spaced apart so that the first and second guide rails 40, 42 engage opposing side portions of the PC card 12 as the PC card 12 is inserted through the opening 25 (see FIG. 3). The PC card 12 slides along, and is guided by the first and second guide rails 40, 42 as the PC card 12 is further advanced in the "−x" direction, i.e., as the PC card is inserted further into the connector 10.

Further advancement of the PC card 12 in the "−x" direction eventually causes the end portion 12*b* of the PC card 12 to reach the cam members 44. Each of the cam members 44 is biased in its first position, as noted above. Moreover, the first major surface 44*e* of each cam member 44 is substantially aligned with a bottom of a respective one of the first and second guide rails 40, 42 when the cam member 44 is in its first position. The guide rails 40, 42 thus guide the PC card 12 onto the first major surface 44*e* of each cam member 44 as the PC card 12 is advanced into the connector 10, as shown in FIG. 5A.

Continued movement of the PC card 12 in the "−x" direction causes the end portion 12*b* of the PC card 12 to contact a second major surface 44*f* of each cam member 44. Further movement of the PC card 12 in the "−x" direction, in conjunction with the interference between the end portion 12*b* and the major surfaces 44*f* and the angled orientation of the major surfaces 44*f*, forces the second portion 44*b* of each cam member 44 rearward and downward, i.e., in the "−x" and "−z" directions, against the bias of the springs 52 (see FIG. 5B). The noted movement of the second portions 44*b* causes the cam members 44 to pivot about the corresponding shaft 50 in a counterclockwise direction, from the perspective of FIGS. 2 and 5A–5C. The direction of movement of the cam members 44 is denoted by the arrow 56 in FIGS. 5B and 5C. (The spring constant for the springs 52 is preferably chosen so that the clockwise bias exerted by the springs 52 slightly opposes the counterclockwise motion of the cam members 44 for card removal purposes.)

Figure 5B:
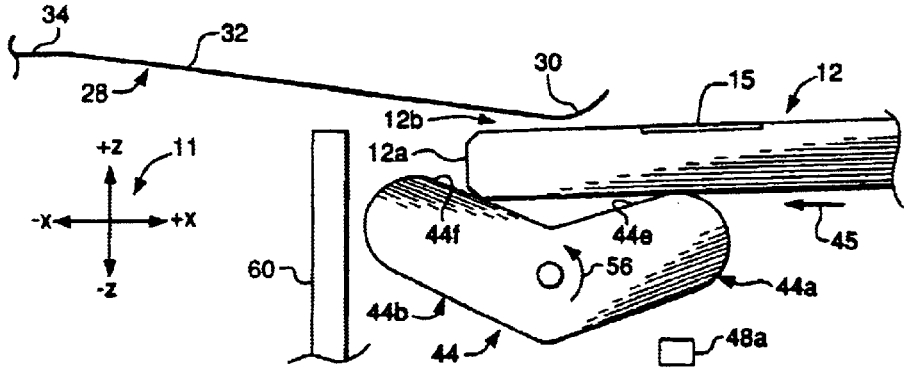
FIG. 5B is a diagrammatic side view of the cam member shown in FIG. 5A as the cam member pivots in response to contact with the PC card shown in FIGS. 1–5A.

The counterclockwise motion of the cam members 44 lifts the end portion 12*b* of the PC card 12, as shown in FIG. 5B. More particularly, the counterclockwise motion of each cam member 44 causes the first portion 44*a* of each cam member 44 (and the corresponding first major surface 44*e*) to move rearward and upward, i.e., in the "−x" and "+z" directions. The upward movement of the first major surfaces 44*e* lifts the end portion 12*b* of the PC card 12.

The terminals 28 and the cam members 44 are positioned so that the upward movement of the end portion 12*b* portion brings the pads 16 on the PC card 12 into contact with the contact portions 30 of the terminals 28. Notably, no substantial contact occurs between any part of the PC card 12 and the contacts 28 before the PC card 12 is lifted by the cam members 44. (The PC card 12 slides along the bottom of each guide rail 40, 42 before reaching the cam members 44. The end portion 12*b* thus remains in a lower position than the terminals 28 before being lifted by the cam members 44, and thereby remains out of contact with the terminals 28 before being lifted.) The substantial advantages associated with this feature are discussed below.

The terminals 24 deflect in response the upward movement of the PC card 12 against the contact portions 30. More particularly, the contact portions of the terminals 28 are pushed upward by the PC card 12. The upward movement of each contact portion 30 causes the adjoining beam portion 32 to bend. The resilience of the beam portions 32 causes the beam portions 32 to resist this bending motion, thereby generating a contact force between the adjoining contact portions 30 and the corresponding pad 16. (The terminals 24 thus function as pre-loaded terminals.)

The cam members 44 thus use the motion of the PC card 12 in the direction of insertion to lift the forward portion of the PC card 12 and thereby establish contact between the terminals 28 and the pads 16. This feature can help to minimize the insertion force needed to fully mate the PC card 12 with the connector 10.

Further movement of the PC card 12 in the "−x" direction causes further rotation of the cam members 44, further upward movement of the first portions 44*a*, and an increase in the contact force between the contact portions 30 and the pads 16. Further movement in the "−x" direction also causes each contact portions 30 to wipe a corresponding one of the pads 16, thereby improving the electrical contact between the contact portions 30 and the pads 16. The wiping distance, i.e., the length of the path of contact between each contact portion 30 and the corresponding pad 16, is preferably approximately five to approximately ten mils.

Figure 5C:
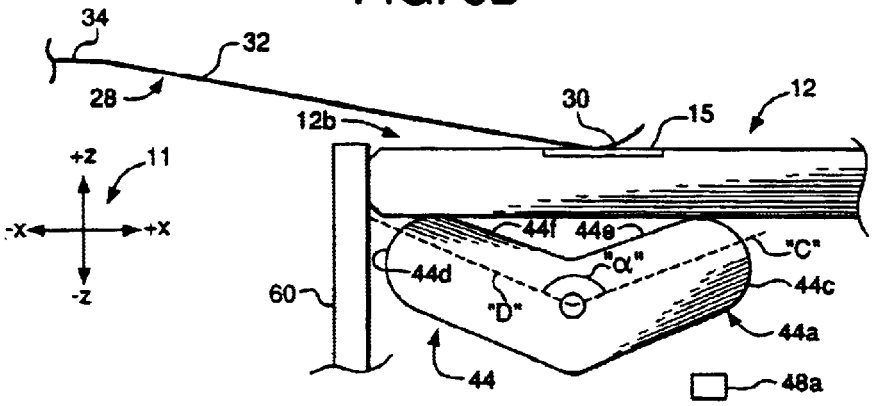
FIG. 5C is a diagrammatic side view of the cam member shown in FIGS. 5A and 5B with the PC card shown in FIGS. 1–5B fully inserted in the connector shown in FIGS. 1–3.

The PC card 12 eventually reaches a stop 60 formed on the terminal portion 26 as the cam members 44 reach the position depicted in FIG. 5C, i.e., as the forward portion 12*b* of the PC card 12 is supported by each of the leading and trailing edges 44*c*, 44*d* of the cam members 44. The PC card 12 is fully inserted in the connector 10 at this point. (The motion of the PC card 10 and the cam member 44 during removal of the PC card 12 are substantially opposite to that described above with respect to the insertion process. The removal process therefore is not described herein, for brevity.)

The rearward portion of the PC card 12 can be lifted a suitable conventional means. For example, a spring system 62, denoted symbolically in FIGS. 2 and 3, can be used to lift the rearward portion of the PC card 12 when the PC card 12 has advanced to a predetermined position within the connector 10. A conventional guide rail and pin system (not shown) that lifts the PC card 12 as the PC card 12 is advanced into the connector 10 can also be used. A detailed description of the means for lifting the rearward portion of the PC card 12 is not necessary for an understanding of the invention, and therefore is not included herein.

Figure 6:
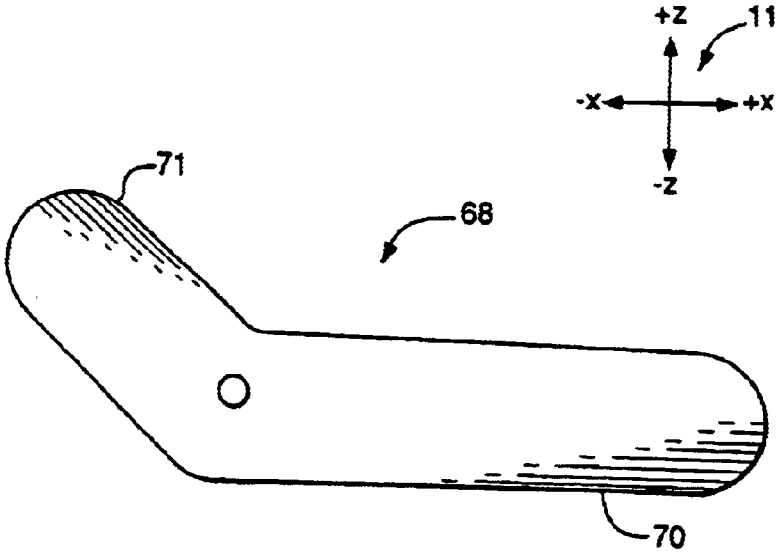
FIG. 6 is a diagrammatic side view of an alternative embodiment of the cam member shown in FIGS. 5A–5C.

Alternatively, the connector 10 can be equipped with a first and second cam member 68 in place of the cam members 44 (see FIG. 6). Each of the cam members 68 comprises a substantially elongated first portion 70, and a second portion 71 that is substantially identical to the second portion 44*b* of the cam members 44. The first portion 70 is sufficiently long to lift the entire PC card 12. Hence, the cam members 68 can negate the need for an additional mechanism to lift the rearward portion of the PC card 12.

The cam members 44 inhibit substantial contact between the forward edge 12*a* of the PC card 12 and the terminals 28 as the PC card 12 is inserted into the connector 10, as discussed above. The cam members 44 also inhibit substantial contact between the casing 14 of the PC card 12 and the terminals 28 as the PC card 12 is inserted. Thus, the use of the cam members 44 can protect the insulating coating on the exterior of the PC card 12 from being scratched or otherwise damaged by contact with the terminals 28 as the PC card 12 is inserted into the connector 10.

More generally, the cam members 44, by minimizing the contact between the PC card 12 and the terminals 28, can minimize wear on the terminals 28 and the PC card 12 caused by repeated insertions and removals of the PC card 12 into and from the connector 10. Hence, use of the cam members 44 can potentially prolong the useful life of the connector 10 and the PC card 12. This feature can be of particular benefit in applications requiring frequent insertion and removal of the PC card 12. Moreover, minimizing the contact between the PC card 12 and the terminals 28 as the PC card 12 is inserted helps to minimize the insertion force needed to mate the PC card 12 with the connector 10. These advantages, as explained above, can be achieved while still providing sufficient contact force and wipe between the terminals 28 and the pads 16 of the PC card.

The cam members 44 form a relatively simple, compact, and inexpensive mechanism for lifting the PC card 12. Moreover, the cam members 44 are self-actuating, i.e., the cam members can raise the PC card 12 in response to the insertion force used to advance the PC card 12 within the connector 10. Hence, the cam members 44 do not require a separate mechanism, or the application of a force other than the insertion force to raise the PC card 12 to its final position within the connector 10. This feature, as noted previously, can help to minimize the insertion force needed to fully mate the PC card 12 with the connector 10.

It is to be understood that even though numerous characteristics and advantages of the present invention have been set forth in the foregoing description, the disclosure is illustrative only and changes may be made in detail within the principles of the invention to the full extent indicated by the broad general meaning of the terms in which the appended claims are expressed.

Figure 7:
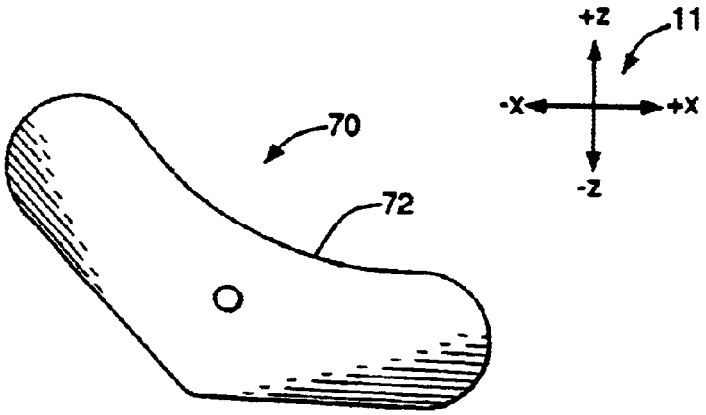
FIG. 7 is a diagrammatic side view of another alternative embodiment of the cam member shown in FIGS. 5A–5C.

For example, FIG. 7 depicts a cam member 70 having an arcuate major surface 72. Two of the cam members 70 can be substituted for the cam members 44 in the connector 10. The cam members 70 function in a manner substantially similar to the cam members 44. In particular, the major surface 72 contacts the PC card 12 as the PC card 12 is inserted into the connector 10, thereby causing the cam member 70 to pivot and the lift the PC card 12.

Figure 8:
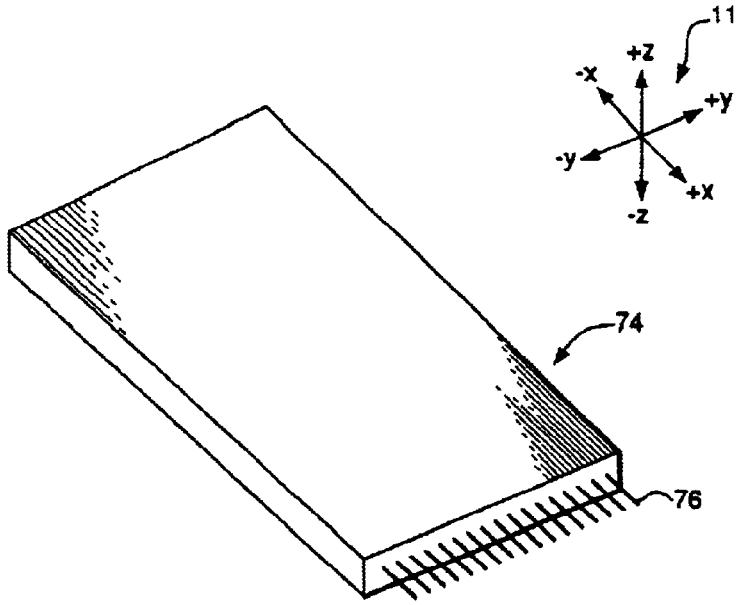
FIG. 8 is a diagrammatic perspective view of a PC card that can be used in conjunction with an alternative embodiment of the connector shown in FIGS. 1–3.
Figure 9:
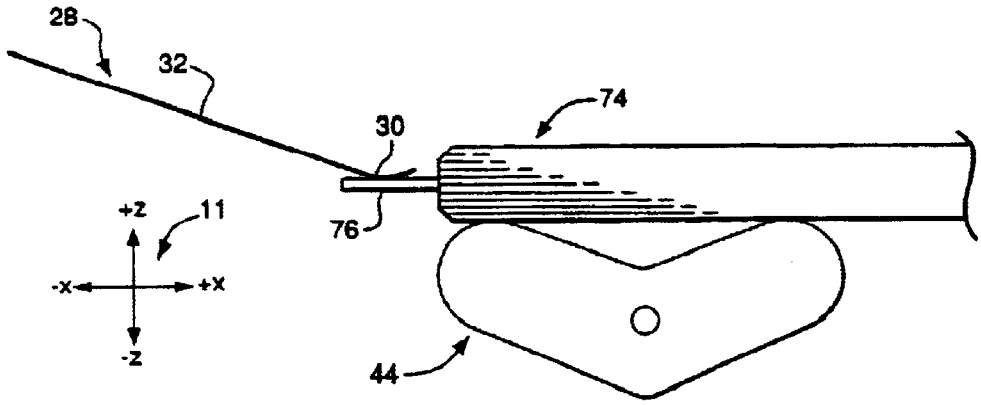
FIG. 9 is a diagrammatic side view of the PC card shown in FIG. 7 fully inserted in an alternative embodiment of the connector shown in FIGS. 1–3.

The present invention can also be used in conjunction with a second type of PC card 74 (see FIGS. 8 and 9). The second type of PC card 74 comprises a plurality of terminals 76 extending from a forward edge thereof. The connector 10 can be configured so that the cam members 44 lift the forward portion of the PC card 74 in a manner that causes each of the terminals 76 to contact a corresponding contact portion 30 of one of the terminals 28, as depicted in FIG. 9.

What is claimed is:

1. A connector for a card-type electronic device, comprising:

a casing having an opening therein for receiving the card-type electronic device;

a plurality of electrically-conductive terminals mounted on the casing; and a cam member pivotally coupled the casing and comprising a first portion and a second portion, wherein an end portion of the card-type electronic device contacts the second portion of the cam member and urges the second portion of the cam member in a first direction in response to an insertion force exerted on the card-type electronic device to advance the card-type electronic device into the connector, and movement of the second portion of the cam member in the first direction causes the first portion of the cam member to lift the end portion of the card-type electronic device in a direction substantially opposite the first direction.

2. The connector of claim 1, wherein lifting the end portion of the card-type electronic device causes the card-type electronic device to contact the terminals.

3. The connector of claim 1, wherein the first portion has a rounded leading edge and the second portion has a rounded trailing edge.

4. The connector of claim 1, wherein the cam member has an arcuate surface, the end portion of the card-type electronic device contacts the arcuate surface as the card-type electronic device is advanced into the connector, and the cam member pivots in response to the contact between the end portion of the card-type electronic device and the arcuate surface.

5. The connector of claim 1, wherein the housing comprises an upper portion, a lower portion secured to the upper portion, and a terminal portion secured to the upper and lower portions.

6. The connector of claim 1, wherein the terminal portion has a plurality of penetrations formed therein and each of the terminals extends through a respective one of the penetrations.

7. The connector of claim 1, wherein each of the terminals comprises a contact portion, a beam portion adjoining the contact portion, and a lead portion adjoining the beam portion.

8. The connector of claim 1, wherein the first portion is substantially longer than the second portion and the first portion lifts a substantial entirety of the card-type electronic device in response to the insertion force.

9. The connector of claim 1, wherein the cam member is pivotally coupled to a mating feature of the casing.

10. The connector of claim 1, further comprising a spring for biasing the cam member in a first direction.

11. The connector of claim 1, wherein the cam member is pivotally coupled to the casing by a shaft extending through a through hole formed in the cam member.

12. The connector of claim 1, wherein advancement of the card-type electronic device into the connector causes the card-type electronic device to initially contact the cam member without substantially contacting the terminals.

13. The connector of claim 12, wherein the cam member pivots and lifts the end portion of the card-type electronic device toward the terminals in response to further advancement of the card-type electronic device after the card-type electronic device initially contacts the cam member.

14. A connector for electrically coupling a card-type electronic device to a substrate, comprising:

a casing having an opening therein for receiving the card-type electronic device;

a plurality of electrically-conductive terminals mechanically coupled to the casing for electrically contacting a plurality of electrical contact points on the circuit substrate; and a cam member pivotable between a first position and a second position, wherein an end portion of the card-type electronic device is positionable over at least a portion of the cam member when the cam member is in the first position, the cam member comprises a first portion having a major surface and a leading edge, and an adjoining second portion having a major surface and a trailing edge, and the cam member pivots in response to contact between the end portion of the card-type electronic device and the major surface of the second portion of the cam member so that the second portion of the cam member moves in a first direction and the first portion of the cam member lifts the end portion of the card-type electronic device in a direction substantially opposite the first direction when the cam member pivots from the first to the second position so that the card-type electronic device is electrically coupled to the terminals.

15. The connector of claim 14, wherein the card-type electronic device is spaced apart from the terminals when the end portion of the card-type electronic device is positioned over the at least a portion of the cam member and the cam member is in the first position.

16. The connector of claim 14, when the end portion of the card-type electronic device is positionable over the at least a portion of the cam member without substantially contacting the terminals when the cam member is in the first position.

17. The connector of claim 14, wherein the cam member lifts a substantial entirety of the card-type electronic device when the cam member is in the second position.

18. A connector for a card-type electronic device, comprising:

a casing having an opening therein for receiving the card-type electronic device;

a plurality of electrically-conductive terminals mounted on the casing; and a cam member comprising a first and a second portion and being pivotally coupled the casing, wherein the card-type electronic device is advanced into the connector in a first direction in response to an insertion force exerted on the card-type electronic device, advancement of the card-type electronic device in the first direction causes the card-type electronic device to initially contact the second portion of the cam member without substantially contacting the terminals, and the second portion of the cam member moves in a second direction causing the cam member to pivot so that the first portion of the cam member lifts an end portion of the card-type electronic device in a third direction substantially opposite the second direction and toward the terminals in response to further advancement of the card-type electronic device after the card-type electronic device initially contacts the cam member.

19. The connector of claim 18, wherein the cam member pivots and lifts a substantial entirety of the card-type electronic device in the second direction toward the terminals in response to further advancement of the card-type electronic device after the card-type electronic device initially contacts the cam member.

* * * * *